US010180648B2

(12) United States Patent
Tanaka et al.

(10) Patent No.: US 10,180,648 B2
(45) Date of Patent: Jan. 15, 2019

(54) IMAGE FORMING APPARATUS WITH IMPROVED CORRECTION BASED ON TONER DENSITY

(71) Applicant: KYOCERA Document Solutions Inc., Osaka (JP)

(72) Inventors: Hiroki Tanaka, Osaka (JP); Kenichi Hayashi, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 15/457,295

(22) Filed: Mar. 13, 2017

(65) Prior Publication Data

US 2017/0285548 A1 Oct. 5, 2017

(30) Foreign Application Priority Data

Mar. 29, 2016 (JP) ..... 2016-066885

(51) Int. Cl.
*G03G 15/00* (2006.01)

(52) U.S. Cl.
CPC ..... *G03G 15/556* (2013.01); *G03G 15/5058* (2013.01); *G03G 2215/0164* (2013.01)

(58) Field of Classification Search
CPC ..... G03G 15/556; G03G 15/5041; G03G 15/5058
See application file for complete search history.

(56) References Cited

U.S. PATENT DOCUMENTS 5,953,554 A 9/1999 Sharp
2006/0165425 A1* 7/2006 Matayoshi ..... G03G 15/5058 399/49
2006/0204267 A1* 9/2006 Watanabe ..... G03G 15/5058 399/74
2011/0311245 A1* 12/2011 Inada ..... G03G 15/0131 399/31
2015/0362878 A1* 12/2015 Nagashima ..... G03G 15/5054 399/49

FOREIGN PATENT DOCUMENTS

| | | |
|---|---|---|
| JP | H10-161416 | 6/1998 |
| JP | 2000-267369 | 9/2000 |
| JP | 2006-201521 | 8/2006 |
| JP | 2006-208266 | 8/2006 |
| JP | 2012-8168 | 1/2012 |
| JP | 2016-45383 | 4/2016 |

* cited by examiner

*Primary Examiner* — Walter L Lindsay, Jr.
*Assistant Examiner* — Arlene Heredia Ocasio

(57) ABSTRACT

A sensor includes a light emitter and a photodetector. The light emitter outputs light with which a toner pattern or a surface material of an image carrier is irradiated. The photodetector receives reflection light from the toner pattern or the surface material. The sensor light intensity control unit provides a control voltage to the light emitter and thereby controls light intensity of the light emitter. The density determining unit determines a toner density on the basis of output of the photodetector. Further, the density determining unit (a) determines as a correction parameter a first-order coefficient of the control voltage of the light emitter for an output voltage of the photodetector corresponding to reflection light from the surface material, (b) determines a correction amount corresponding to the correction parameter and the toner density, and (c) corrects the toner density on the basis of the correction amount.

3 Claims, 8 Drawing Sheets

REFERENCE:
(SPECULAR REFLECTION) - (DIFFUSE REFLECTION)

CHIP POSITION DEVIATED:
(SPECULAR REFLECTION) - (DIFFUSE REFLECTION)

IMAGE FORMING APPARATUS WITH IMPROVED CORRECTION BASED ON TONER DENSITY

CROSS-REFERENCE TO RELATED APPLICATIONS

This application relates to and claims priority rights from Japanese Patent Application No. 2016-066885, filed on Mar. 29, 2016, the entire disclosures of which are hereby incorporated by reference herein.

BACKGROUND

1. Field of the Present Disclosure

The present disclosure relates to an image forming apparatus.

2. Description of the Related Art

A measurement method of a toner density on an image carrier using a reflection type optical sensor calculates an index (e.g. coverage factor mentioned below or the like) that indicates a toner density on the basis of a change of an output voltage of the reflection type optical sensor.

Such reflection type optical sensor is of a specular-reflection-and-diffuse-reflection-separating type or of a polarization splitting type.

Of the specular-reflection-and-diffuse-reflection-separating type, the reflection type optical sensor includes two photodetectors that receive specular reflection light and diffuse reflection light, respectively. Specifically, the specular-reflection-light photodetector is arranged on an optical axis of reflection light of incoming light, and the diffuse-reflection-light photodetector is arranged out of the optical axis. Outputs of these photodetectors are used for the detection of the toner density.

The polarization splitting type utilizes a polarization characteristic of color toner, and arranges a beam splitter, causes a specific polarized light to enter the beam splitter, splits the reflection light into P-polarized light and S-polarized light using the beam splitter, and receives the P-polarized light and the S-polarized light using two photodetectors. Outputs of these photodetectors are used for the detection of the toner density.

The detection of the toner density is performed on the basis of a ratio between a sensor output of a surface material part of the image carrier (i.e. a surface part on which toner does not adhere) and a sensor output of a toner part (i.e. a surface part on which toner adheres). Using this ratio gives an advantage to enable to exclude influence of dirt on a head part of a light emitting unit in an optical sensor, light intensity fluctuation of an LED (Light Emitting Diode) as a light emitter of an optical sensor and the like.

Under a condition that all incoming light to black toner is absorbed by the black toner and incoming light to color toner diffusely reflects completely, regardless of toner type (i.e. black toner or color toner), a coverage factor M of toner on an image carrier is expressed as the following formula.

$$M=1-\{(R-Rd)-(D-Dd)\}/\{(Rg-Rd)-(Dg-Dd)\}$$

Here Rd is a dark potential of the specular-reflection-light photodetector, Dd is a dark potential of the diffuse-reflection-light photodetector, Rg is a detection voltage of specular reflection light from the surface material, Dg is a detection voltage of diffuse reflection light from the surface material, R is a detection voltage of specular reflection light from the toner part, and S is a detection voltage of diffuse reflection light from the toner part.

The aforementioned reflection type optical sensor is a sensor that includes a shell type LED and a shell type PD (Photo Diode) or a surface mount type sensor that includes a chip-shaped LED and a chip-shaped PD surface-mounted on a circuit board. In the surface mount type sensor, the chip-shaped LED and the chip-shaped PD do not include light focusing function and therefore focusing lenses are installed other than the chip-shaped LED and the chip-shaped PD.

When using the surface mount type sensor, in addition to dispersion on a relative distance and a relative angle between an installation position of the optical sensor and the image carrier, dispersion occurs on an installation position of the LED chip and the PD chip on the sensor circuit board due to separate installation of the focusing lenses.

FIG. 8 shows a diagram that indicates characteristics of a sensor photodetection voltage to a toner density in a reference condition (i.e. no dispersion) and in a condition where dispersion occurs on a chip position. FIG. 8 indicates characteristics in a case of using a transfer belt with a high glossiness (i.e. a glossiness of 60 approximately).

Due to the aforementioned dispersion, as shown in FIG. 8, the photodetection intensity of the reflection light changes, and in particular, the photodetection intensity of the specular reflection light from the image carrier changes significantly. Consequently, the aforementioned dispersion results in dispersion on a relationship between an actual toner density and a measured toner density (e.g. the aforementioned coverage factor or the like) calculated on basis of the photodetection intensity, and therefore the measured toner density may not precisely obtained.

SUMMARY

An image forming apparatus according to an aspect of the present disclosure includes an image carrier configured to carry a toner pattern, a sensor, a sensor light intensity control unit, and a density determining unit. The sensor includes a light emitter and a photodetector, the light emitter is configured to output light with which the toner pattern or a surface material of the image carrier is irradiated, and the photodetector is configured to receive reflection light from the toner pattern or the surface material of the image carrier. The sensor light intensity control unit is configured to provide a control voltage to the light emitter and thereby control light intensity of the light emitter. The density determining unit is configured to determine a toner density on the basis of output of the photodetector. Further, the density determining unit (a) determines as a correction parameter a first-order coefficient of a control voltage of the light emitter for an output voltage of the photodetector corresponding to reflection light from the surface material of the image carrier, (b) determines a correction amount corresponding to the correction parameter and the toner density, and (c) corrects the toner density on the basis of the correction amount.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
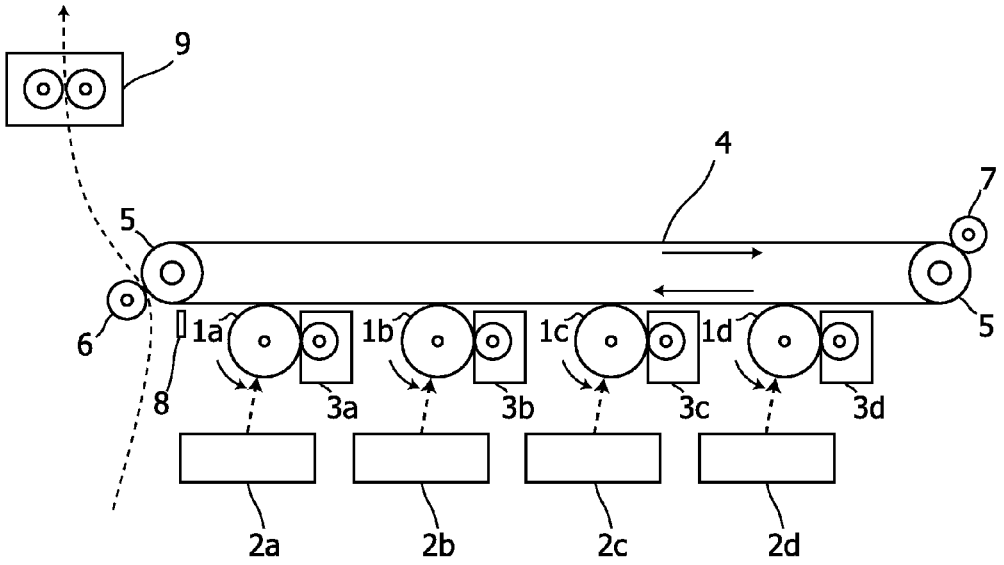
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus having an electrographic-type printing function such as a printer, a facsimile machine, a copier, or a multi function peripheral.

The image forming apparatus in the present embodiment includes a tandem-type color development device. This color development device includes photoconductor drums 1*a* to 1*d*, exposure devices 2*a* to 2*d*, and development devices 3*a* to 3*d* for respective colors. The photoconductor drums 1*a* to 1*d* are four color photoconductors of Cyan, Magenta, Yellow and Black. The exposure devices 2*a* to 2*d* are devices that form electrostatic latent images by irradiating the photoconductor drums 1*a* to 1*d* with laser light. Each of the exposure devices 2*a* to 2*d* includes a laser diode as a light emitter of the laser light, optical elements (such as lens, mirror and polygon mirror) that guide the laser light to the photoconductor drum 1*a*, 1*b*, 1*c*, or 1*d*.

Further, in the periphery of each one of the photo conductor drums 1*a* to 1*d*, a charging unit, a cleaning device, a static electricity eliminator and the like are disposed. The charging device is of a scorotron type or the like and charges the photoconductor drum 1*a*, 1*b*, 1*c*, or 1*d*. The cleaning device removes residual toner on each one of the photo conductor drums 1*a* to 1*d* after primary transfer. The static electricity eliminator eliminates static electricity of each one of the photo conductor drums 1*a* to 1*d* after primary transfer.

Toner containers are attached to the development devices 3*a* to 3*d*, and the toner containers are filled up with toner of four colors: Cyan, Magenta, Yellow and Black, respectively. Development biases are applied between the development devices 3*a* to 3*d* and the photoconductor drums 1*a* to 1*d*, respectively, and thereby the development devices 3*a* to 3*d* cause the toner supplied from the toner containers to adhere to electrostatic latent images on the photoconductor drums 1*a* to 1*d*, respectively, and consequently form toner images of the four colors. For example, a developer is composed of the toner and a carrier with external additives such as titanium dioxide.

The photoconductor drum 1*a*, the exposure device 2*a* and the development device 3*a* perform development of Magenta. The photoconductor drum 1*b*, the exposure device 2*b* and the development device 3*b* perform development of Cyan. The photoconductor drum 1*c*, the exposure device 2*c* and the development device 3*c* perform development of Yellow. The photoconductor drum 1*d*, the exposure device 2*d* and the development device 3*d* perform development of Black.

The intermediate transfer belt 4 is an image carrier and endless (i.e. loop-shaped) intermediate transferer that contacts the photoconductor drums 1*a* to 1*d*. Toner images on the photoconductor drums 1*a* to 1*d* are primarily transferred onto the intermediate transfer belt 4. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

In this embodiment, the intermediate transfer belt 4 is, for example, a resin belt that includes a substrate such as polyamide or polyimide with surface coating.

A transfer roller 6 causes a conveyed paper sheet to contact the transfer belt 4, and secondarily transfers the toner image on the transfer belt 4 to the paper sheet.

The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet. Instead of the roller 7 having a cleaning brush, a cleaning blade may be used.

A sensor 8 irradiates the intermediate transfer belt 4 with a light beam and detects its reflection light in order to measure a toner density. In density adjustment, a test toner pattern is formed on the intermediate transfer belt 4, and the sensor 8 irradiates with a light beam a predetermined area where the test toner pattern passes, detects its reflection light, and outputs an electrical signal corresponding to the detected intensity of the reflection light.

Figure 2:
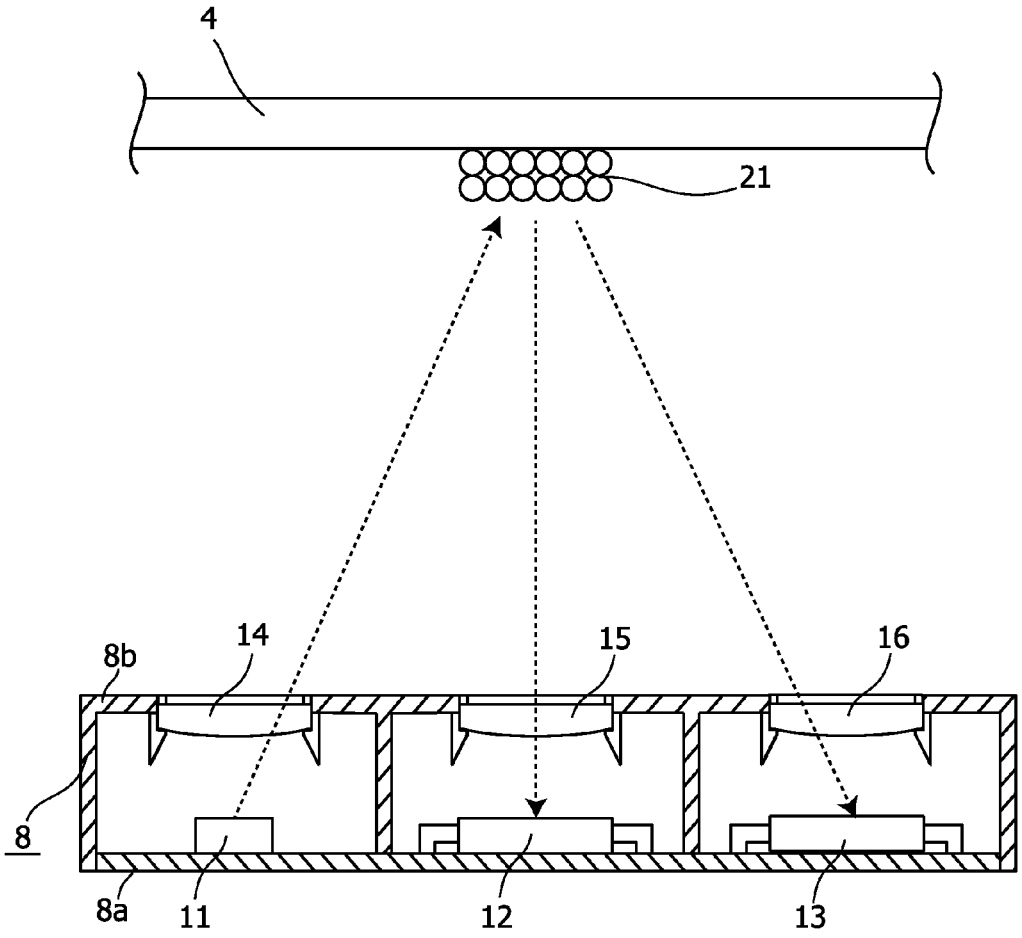
FIG. 2 shows a diagram that indicates an example of a configuration of a sensor 8 shown in FIG. 1.

FIG. 2 shows a diagram that indicates an example of a configuration of a sensor 8 shown in FIG. 1.

The sensor 8 shown in FIG. 2 includes a circuit board 8*a* and a sensor cover 8*b*, and the circuit board 8*a* is equipped with the sensor cover 8*b*. A chip-shaped light emitter 11 and chip-shaped photodetectors 12 and 13 are surface-mounted on the circuit board 8*a*, and the sensor cover 8*b* has three holes, and focusing lenses 14, 15 and 16 are arranged at positions corresponding to these holes, and corresponds to the light emitter 11 and the photodetectors 12 and 13, respectively.

The light emitter 11 outputs light and irradiates a toner pattern on the intermediate transfer belt 4 or a surface material of the intermediate transfer belt 4 with the light through the focusing lens 14. The photodetector 12 receives diffuse reflection light in reflection light from the toner pattern or the surface material, of the light outputted by the light emitter 11. The photodetector 13 receives specular reflection light in reflection light from the toner pattern or the surface material, of the light outputted by the light emitter 11.

For example, the light emitter 11 is an LED and the photodetectors 12 and 13 are PDs.

Figure 3:
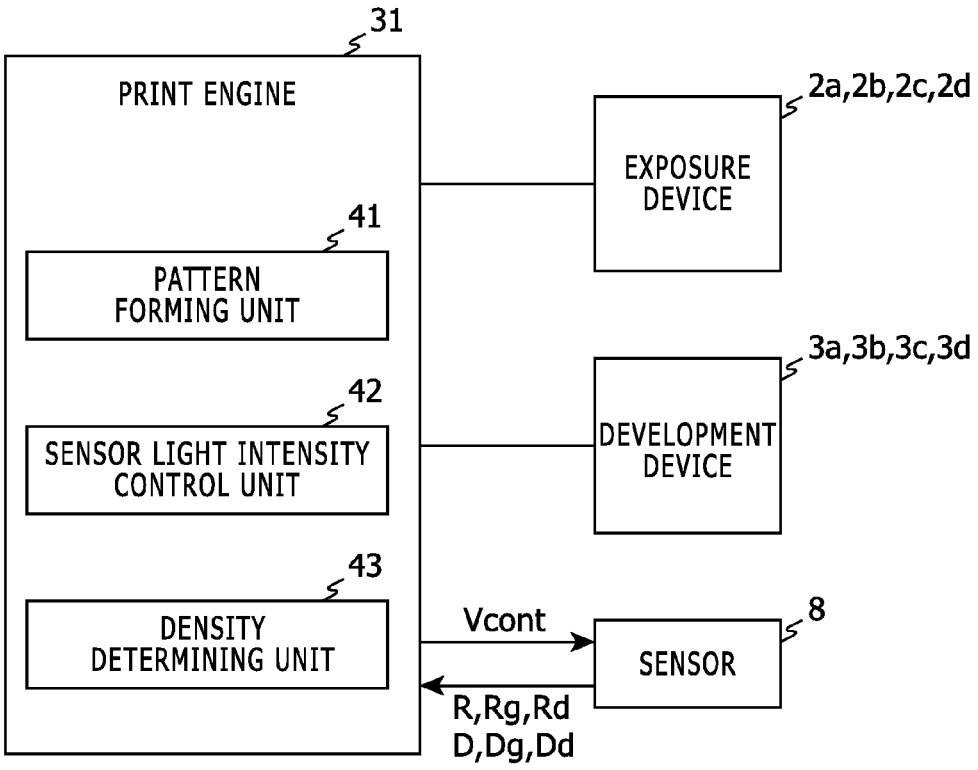
FIG. 3 shows a block diagram that indicates an electronic configuration of the image forming apparatus in the embodiment according to the present disclosure.

FIG. 3 shows a block diagram that indicates an electronic configuration of the image forming apparatus in the embodiment according to the present disclosure. In FIG. 3, the print engine 31 controls a driving source that drives the aforementioned rollers, a bias induction circuit that induces a primary transfer bias, the development device 3*a* to 3*d*, the exposure devices 2*a* to 2*d* and the like, and thereby performs developing, transferring and fixing the toner image, feeding a paper sheet, printing on the paper sheet, and outputting the paper sheet. The primary transfer bias is induced between the photoconductor drums 1*a* to 1*d* and the intermediate transfer belt 4, respectively. The print engine 31 is a processing circuit that includes a computer that acts in accordance with a control program, an ASIC (Application Specific Integrated Circuit) and/or the like.

Further, the print engine 31 controls the sensor 8 and thereby at regular intervals or predetermined timing, performs an adjustment (calibration) of density gradation, maximum density or the like. A D/A (Digital to Analog) converter, an amplifiers and the like are disposed between the print engine 31 and the light emitter 11 if necessary. Amplifiers, A/D (Analog to Digital) converters and the like are disposed between the photodetectors 12 and 13 and the print engine 31 if necessary.

The print engine 31 includes a pattern forming unit 41, a sensor light intensity control unit 42, and a density determining unit 43.

In the calibration, the pattern forming unit 41 controls the exposure devices 2*a* to 2*d* and the development devices 3*a* to 3*d* and thereby forms toner patterns of respective toner colors on the intermediate transfer belt 4.

The sensor light intensity control unit 42 supplies a control voltage to the light emitter 11, and thereby controls emitting light intensity of the light emitter 11. The sensor 8 makes light incident to the toner patterns on the intermediate transfer belt 4, and receives reflection light thereof.

The density determining unit 43 determines a toner density on the basis of outputs of the photodetectors 12 and 13 in the sensor 8.

Specifically, the density determining unit 43 (a) determines as a correction parameter G a first-order coefficient (slope) of a control voltage of the light emitter 11 for an output voltage of the photodetector 13 (or a difference between an output voltage of the photodetector and an output voltage of the photodetector 12) corresponding to reflection light from the surface material of the intermediate transfer belt 4, (b) determines a correction amount corresponding to the correction parameter and the toner density, and (c) corrects the toner density on the basis of the correction amount. For example, the toner density (before the correction) is calculated as the aforementioned coverage factor M according to the following formula.

$$M=1-\{(R-Rd)-(D-Dd)\}/\{(Rg-Rd)-(Dg-Dd)\}$$

For example, the density determining unit 43 (a) changes the control voltage Vcont of the light emitter 11, (b) determines plural output voltages Rg1 and Rg2 of the photodetector 13 corresponding to reflection light from the surface material of the intermediate transfer belt 4 at plural control voltages V1 and V2 of the light emitter 11, and (c) determines as the correction parameter G the aforementioned first-order coefficient on the basis of the plural control voltages V1 and V2 and the plural output voltages Rg1 and Rg2, for example, in accordance with the following formula.

$$G=(V1-V2)/(Rg1-Rg2)$$

Alternatively, the density determining unit 43 (a) controls the control voltage Vcont of the light emitter 11 so as to set the output voltage of the photodetector 13 as a predetermined reference value, (b) determines the output voltage of the photodetector 13 corresponding to reflection light from the surface material of the image carrier at this control voltage Vcont of the light emitter 11, and (c) determines as the correction parameter G the aforementioned first-order coefficient on the basis of the control voltage, the output voltage, a light-emission-start voltage Vs of the light emitter 11, and a dark potential of the photodetector 13, for example, in accordance with the following formula.

$$G=\{(Rg-Rd)-(Dg-Dd)\}/(V\text{cont}-Vs)$$

Figure 4:
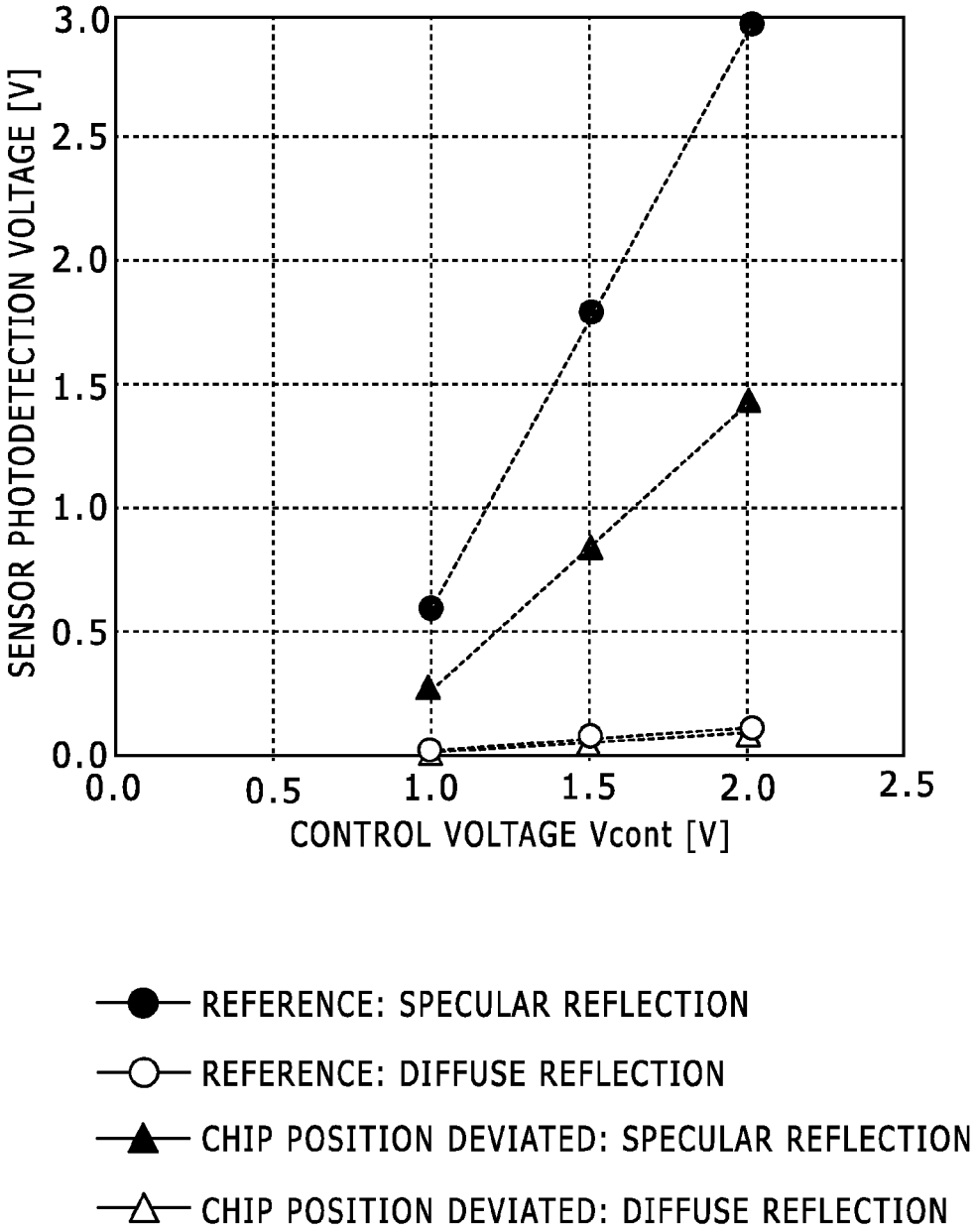
FIG. 4 shows a diagram that indicates characteristics of a sensor photodetection voltage to a control voltage of a light emitter in the sensor in a reference condition (i.e. no dispersion) and in a condition where dispersion occurs on a chip position.
Figure 5:
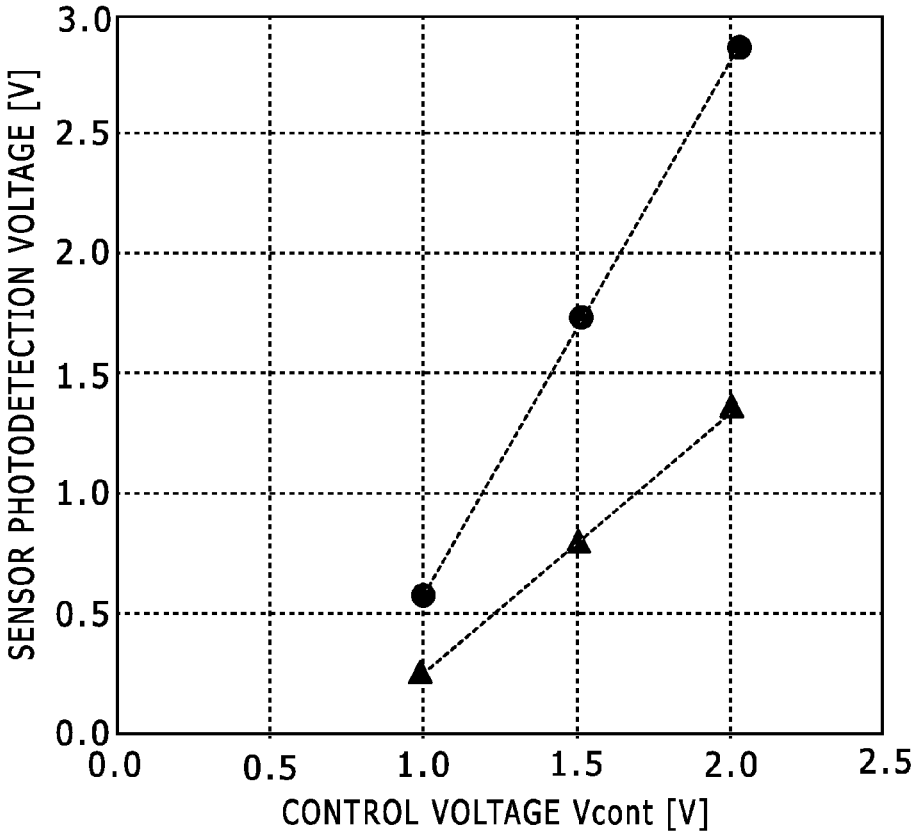
FIG. 5 shows a diagram that indicates characteristics of a sensor photodetection voltage (here a difference between a photodetection voltage of specular reflection light and a photodetection voltage of diffuse reflection light) to a control voltage of a light emitter in the sensor in a reference condition (i.e. no dispersion) and in a condition where dispersion occurs on a chip position.

FIG. 4 shows a diagram that indicates characteristics of a sensor photodetection voltage to a control voltage of a light emitter in the sensor in a reference condition (i.e. no dispersion) and in a condition where dispersion occurs on a chip position. FIG. 5 shows a diagram that indicates characteristics of a sensor photodetection voltage (here a difference between a photodetection voltage of specular reflection light and a photodetection voltage of diffuse reflection light) to a control voltage of a light emitter in the sensor in a reference condition (i.e. no dispersion) and in a condition where dispersion occurs on a chip position.

As shown in FIGS. 4 and 5, the sensor photodetection voltage has linearity to the control voltage of the light emitter, and a slope of a characteristic (i.e. a linear expression) shown in FIGS. 4 and 5 (i.e. the aforementioned first-order coefficient) changes in accordance with a degree of arrangement dispersion of the sensor 8 (i.e. position dispersion of the sensor and/or angle dispersion of the sensor, local position dispersion of the light emitter and the photodetector in the sensor, and/or the like).

As shown in FIG. 4, the light-emission-start voltage Vs of the light emitter is not zero, but determined by a characteristic of the light emitter, here approximately 0.7 Volt.

Therefore, the density determining unit 43 corrects the measured toner density (the coverage factor) so as to restrain dispersion of the measured toner density (the coverage factor) that occurs due to the arrangement dispersion of the sensor 8 by using the aforementioned correction parameter G correlated to the arrangement dispersion of the sensor 8.

Figure 6:
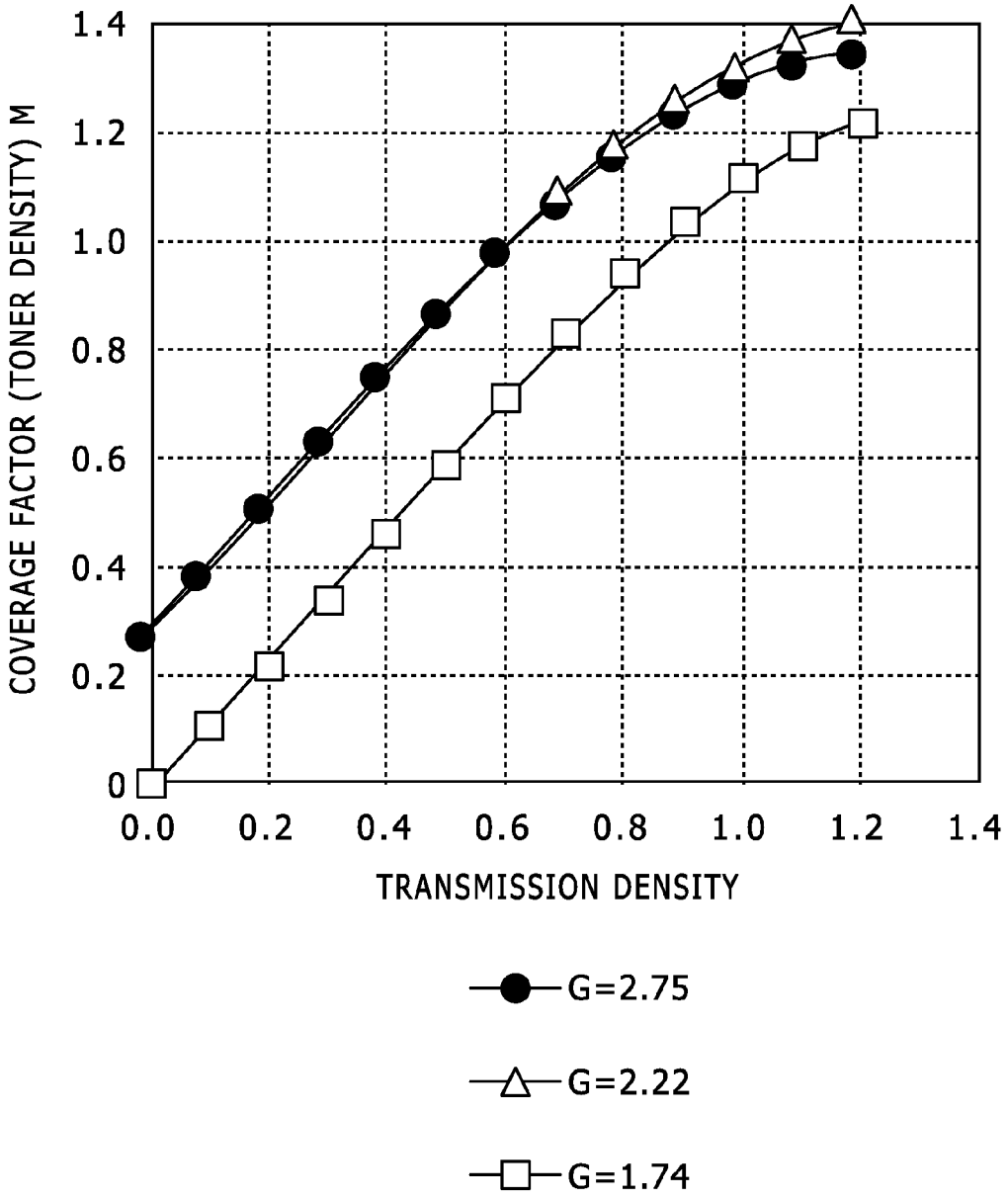
FIG. 6 shows a diagram that indicates a relationship between an actual toner density and a coverage factor (measured toner density) M at plural states of the correction parameter G.

FIG. 6 shows a diagram that indicates a relationship between an actual toner density and a coverage factor (measured toner density) M at plural states of the correction parameter G.

As mentioned, the arrangement dispersion of the sensor 8 results in the dispersion of the correction parameter G, and therefore, even if an actual toner density keeps the same, a measurement value of the toner density (i.e. the coverage factor M) changes as shown in FIG. 6, for example.

Thus, the density determining unit 43 considers as a reference characteristic a characteristic of a measurement value of the toner density (the coverage factor M) when the correction parameter G is equal to a specific value, and corrects a characteristic of a measurement value of the toner density (the coverage factor M) to the reference characteristic on the basis of a measurement value of the reference control voltage Vcont, and thereby performs the correction corresponding to a change of the glossiness of the intermediate transfer belt 4 for a measurement value of the toner density (the coverage factor M).

Figure 7:
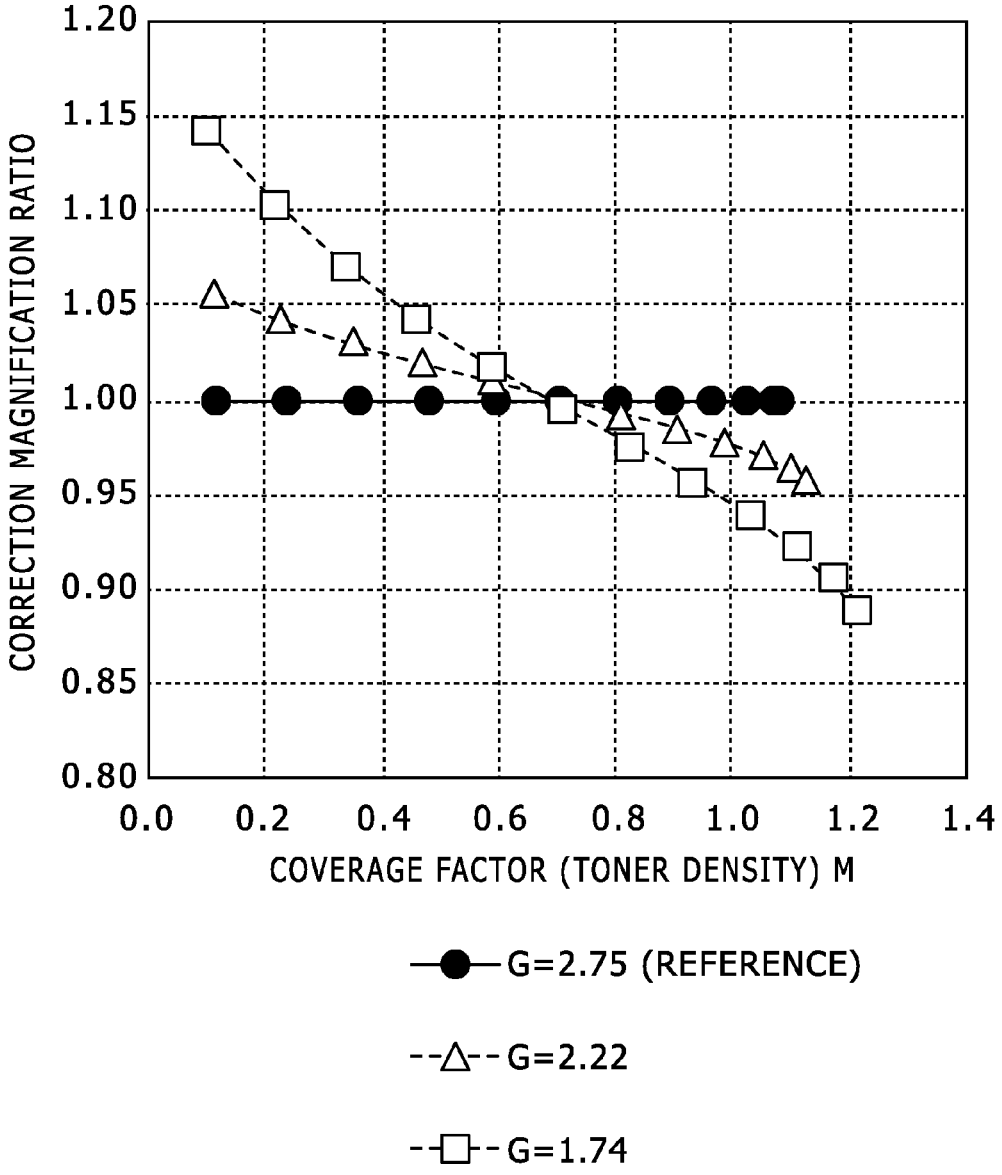
FIG. 7 shows a diagram that indicates a relationship between a coverage factor (toner density) M and a correction magnification ratio (correction amount) at plural conditions of the correction parameter G.
Figure 8:
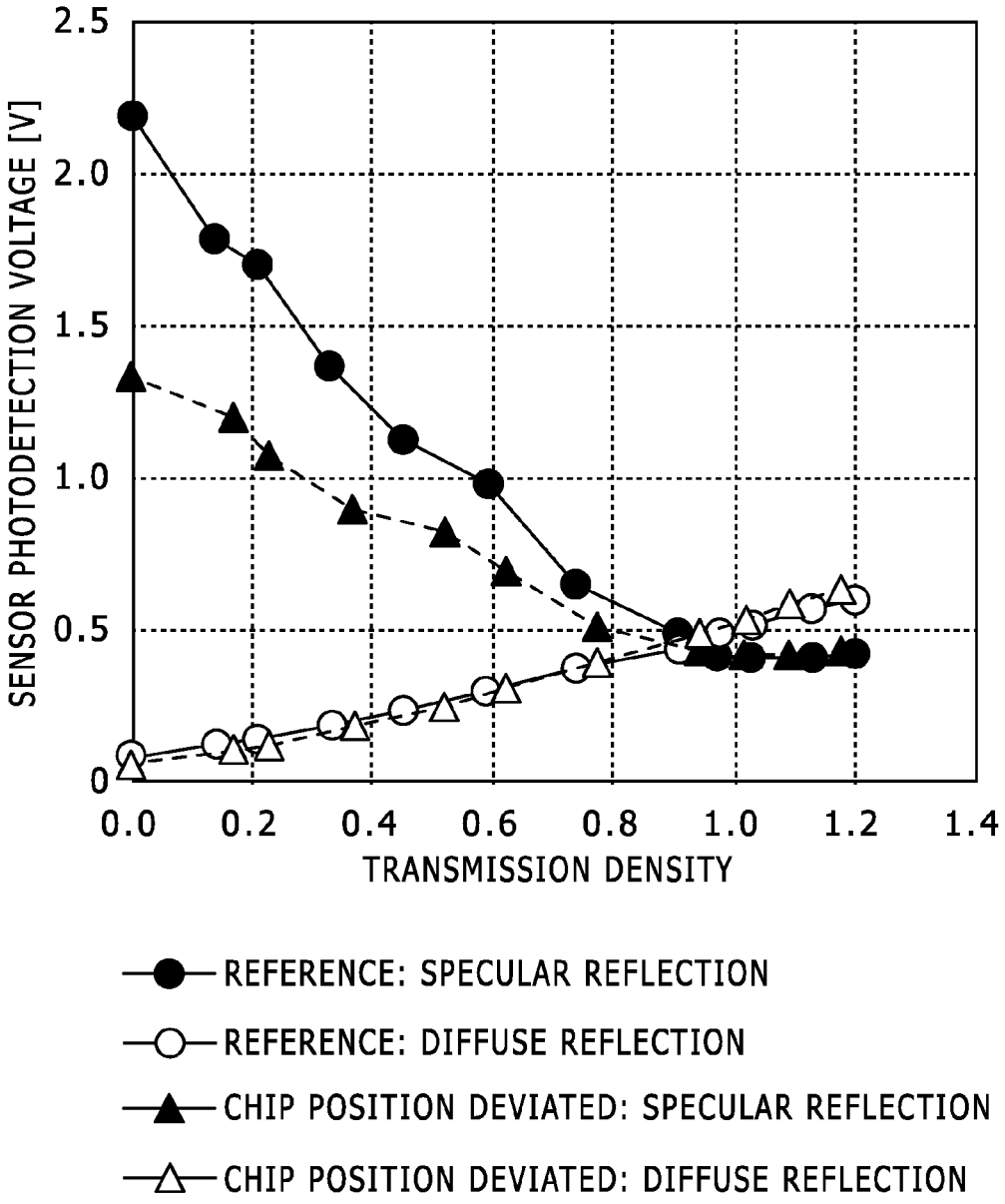
FIG. 8 shows a diagram that indicates characteristics of a sensor photodetection voltage to a toner density in a reference condition (i.e. no dispersion) and in a condition where dispersion occurs on a chip position.

FIG. 7 shows a diagram that indicates a relationship between a coverage factor (toner density) M and a correction magnification ratio (correction amount) at plural conditions of the correction parameter G.

For example, as shown in FIG. 7, correction magnification ratio data has been stored in an unshown non-volatile storage device, and the correction magnification ratio data is for correcting a characteristic of a measurement value of the toner density (the coverage factor M) to the reference characteristic; and the density determining unit 43 determines a correction magnification ratio corresponding to the determined value of the correction parameter G and the measurement value of the toner density (the coverage factor M) on the basis of such correction magnification ratio data, and corrects the measurement value of the toner density by multiplying the measurement value of the toner density (the coverage factor M) by this correction magnification ratio.

In the case shown in FIG. 7, the characteristic at G=2.75 is used as the reference characteristic.

The correction magnification ratio data may be stored as a table such as a lookup table or may be stored as data indicating a type of function of the correction magnification ratio (e.g. polynomial function) and a constant used in the function (e.g. a coefficient of each order in the polynomial function).

Consequently, a measurement value of the toner density is corrected to a toner density obtained in an arrangement condition of the sensor 8 at the reference characteristic, and this correction restrains influence of the arrangement dispersion of the sensor 8 on the measurement value of the toner density.

The following part explains a behavior of the aforementioned image forming apparatus.

Firstly, the sensor light intensity control unit 42 adjusts light intensity of the light emitter 11 of the sensor 8 so as to set photodetection output of Rg as a predetermined value, thereby determines a reference control voltage Vcont, and drives the light emitter 11 with the reference control voltage Vcont.

The density determining unit 43 determines a value of the correction parameter G from the control voltage Vcont and output voltages of the photodetectors 12 and 13 as mentioned, and determines a correction characteristic (a characteristic of the correction magnification ratio to the coverage factor M) corresponding to the determined value of the correction parameter G on the basis of the correction magnification ratio data.

Subsequently, the density determining unit 43 measures the dark potentials Rd and Dd, and measures Rg and Dg of the surface material at a predetermined position of the intermediate transfer belt 4 using the sensor 8.

After the measurement of Rg and Dg of the surface material, the pattern forming unit 41 forms a toner pattern at the predetermined position, and the density determining unit 43 measures R and D of the toner pattern at the predetermined position.

Subsequently, the density determining unit 43 calculates the toner density (the aforementioned coverage factor M) from the measurement values of Rg, Dg, Rd, Dd, R, and D.

The density determining unit 43 determines the correction magnification ratio corresponding to the toner density (the coverage factor M) on the basis of the aforementioned determined correction characteristic. Subsequently, the density determining unit 43 multiplies the aforementioned toner density by the correction magnification ratio determined as mentioned, and thereby obtains the corrected toner density.

In the aforementioned embodiment, the light emitter 11 outputs light with which a toner pattern on the intermediate transfer belt 4 or a surface material of the intermediate transfer belt 4 is irradiated. The photodetectors 12 and 13 receive reflection light from the toner pattern or the surface material of the intermediate transfer belt 4. The sensor light intensity control unit 42 supplies a control voltage to the light emitter 11, and thereby controls light intensity of the light emitter 11. The density determining unit 43 determines a toner density of the toner pattern on the basis of output of the photodetectors 12 and 13. Further, the density determining unit 43 (a) determines as a correction parameter G a first-order coefficient of a control voltage of the light emitter 11 for output voltages of the photodetectors 12 and 13 corresponding to reflection light from the surface material of the intermediate transfer belt 4, (b) determines a correction amount corresponding to the correction parameter and the toner density, and (c) corrects the toner density on the basis of the correction amount.

Thus, the correction amount is decided using the correction parameter G correlated to the arrangement dispersion of the sensor 8, and consequently, the measured toner density is properly corrected so as to restrain an error that occurs due to the arrangement dispersion of the sensor 8.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

Further, in the aforementioned embodiment, a characteristic at a specific value of the correction parameter G is set as the reference characteristic, and the correction is performed so as to fit with the reference characteristic. Alternatively, when a measurement value of the toner density is corrected using gamma correction, for example, and thereby a relationship between a measurement value of the toner density and the actual toner density is made close to a linear, gradation levels of the toner density after this correction may be set as the reference characteristic.

What is claimed is:

1. An image forming apparatus, comprising:

an image carrier configured to carry a toner pattern;

a sensor that comprises a light emitter and a photodetector, the light emitter configured to output light with which the toner pattern or a surface material of the image carrier is irradiated, the photodetector configured to receive reflection light from the toner pattern or the surface material of the image carrier;

a sensor light intensity control unit configured to provide a control voltage to the light emitter and thereby control light intensity of the light emitter; and a density determining unit configured to determine a toner density on the basis of output of the photodetector;

wherein the density determining unit (a) determines as a correction parameter a first-order coefficient of a control voltage of the light emitter for an output voltage of the photodetector corresponding to reflection light from the surface material of the image carrier, (b) determines a correction amount corresponding to the correction parameter and the toner density, (c) corrects the toner density on the basis of the correction amount, and (d) determines the output voltage of the photodetector corresponding to reflection light from the surface material of the image carrier at the control voltage of the light emitter; and determines as the correction parameter the first-order coefficient on the basis of the control voltage, the output voltage, a light-emission-start voltage of the light emitter, and a dark potential of the photodetector.

2. The image forming apparatus according to claim 1, wherein:

the sensor is a surface mount type sensor;

the light emitter is a chip-shaped light emitter arranged on a circuit board; and the photodetector is a chip-shaped photodetector arranged on the circuit board.

3. The image forming apparatus according to claim 1, wherein:

the sensor includes a first photodetector configured to receive specular reflection light in the reflection light, and a second photodetector configured to receive diffuse reflection light in the reflection light; and the density determining unit (e) determines as the correction parameter the first-order coefficient of the control voltage of the light emitter for (e1) an output voltage of the first photodetector corresponding to reflection light from the surface material of the image carrier or (e2) a difference between the first photodetector and the second photodetector corresponding to reflection light from the surface material of the image carrier, (f) determines a correction amount corresponding to the correction parameter and the toner density, and (g) corrects the toner density on the basis of the correction amount.

* * * * *